US008033936B2

(12) United States Patent
Ou

(10) Patent No.: US 8,033,936 B2
(45) Date of Patent: Oct. 11, 2011

(54) SPORTS BALL

(76) Inventor: Tsung Ming Ou, Kaohsiung (TW)

( * ) Notice: Subject to any disclaimer, the term of this patent is extended or adjusted under 35 U.S.C. 154(b) by 0 days.

(21) Appl. No.: 12/924,609

(22) Filed: Sep. 29, 2010

(65) Prior Publication Data

US 2011/0017383 A1 Jan. 27, 2011

Related U.S. Application Data

(62) Division of application No. 11/637,378, filed on Dec. 11, 2006, now Pat. No. 7,837,581.

(51) Int. Cl.
*A63B 41/10* (2006.01)
*B32B 37/10* (2006.01)

(52) U.S. Cl. ..... 473/605; 156/156; 473/599

(58) Field of Classification Search ..... 473/603–605, 473/597, 599, 607; 156/146, 147, 152, 155, 156/156, 293
See application file for complete search history.

(56) References Cited

U.S. PATENT DOCUMENTS

| | | | | | |
|---|---|---|---|---|---|
| 2,129,237 | A * | 9/1938 | Riddell | 156/147 |
| 2,211,670 | A * | 8/1940 | Reach | 156/147 |
| RE21,901 | E * | 9/1941 | Reach | 156/147 |
| 3,256,019 | A * | 6/1966 | Barton | 473/597 |
| 3,506,265 | A * | 4/1970 | Yugi | 473/604 |
| 4,187,134 | A * | 2/1980 | Svub et al. | 156/147 |
| 4,239,568 | A * | 12/1980 | Takazawa | 156/155 |
| 4,333,648 | A * | 6/1982 | Aoyama | 473/604 |
| 6,302,815 | B1 * | 10/2001 | Shishido et al. | 473/604 |
| 6,422,961 | B1 * | 7/2002 | Feeney | 473/604 |
| 6,503,162 | B1 * | 1/2003 | Shishido et al. | 473/605 |
| 6,544,133 | B2 * | 4/2003 | Ou | 473/604 |
| 6,638,189 | B2 * | 10/2003 | Chang | 473/605 |
| 6,663,520 | B2 * | 12/2003 | Ou Chen | 473/604 |
| 7,066,853 | B2 * | 6/2006 | Chang | 473/605 |
| 2007/0060426 | A1 * | 3/2007 | Maziarz et al. | 473/605 |

* cited by examiner

*Primary Examiner* — Steven Wong
(74) *Attorney, Agent, or Firm* — Raymond Y. Chan; David and Raymond Patent Firm

(57) ABSTRACT

A sports ball includes an inflatable bladder, and a ball carcass. The ball pocket is constructed to have a true roundness shape, having an interior cavity receiving the inflatable bladder therein, wherein when the inflatable bladder is inflated, the ball pocket retains a true roundness shape of the inflatable bladder. The ball carcass includes a ball cushion and a plurality of carcass panels. Each of the carcass panels has a peripheral edge and a flat bottom surface defined within the peripheral edge, wherein the bottom surface of each of the carcass panels is entirely affixed to the ball cushion at a position that the peripheral edge of each of the carcass panels is fittingly aligned with the peripheral edges of the adjacent carcass panels to form a roundness carcass of the sportsball in a stitch-less manner.

15 Claims, 8 Drawing Sheets

SPORTS BALL

CROSS REFERENCE OF RELATED APPLICATION

This is a Divisional application that claims the benefit of priority under 35U.S.C.§119 to a non-provisional application, application Ser. No. 11/637,378, filed Dec. 11, 2006, now U.S. Pat. No. 7,837,581.

BACKGROUND OF THE PRESENT INVENTION

1. Field of Invention

The present invention relates to a ball, and more particularly to a sports ball comprising a plurality of carcass panels attached on a ball cushion to form a roundness carcass of the sports ball in a stitch-less manner.

2. Description of Related Arts

A conventional sports ball, such as a conventional soccer ball, usually comprises a ball bladder, an inner lining, and a ball carcass. The ball carcass comprises a plurality of carcass panels attached on the ball bladder, wherein each of the carcass panels is usually stitched to adjacent carcass panels for forming a substantially round sports ball. Traditionally, much has been done in the development of the ball bladder and intermediate construction between the ball bladder and the ball carcass. For example, U.S. Pat. No. 6,663,520 to Li Chin Ou Chen discloses a ball pocket bladder for a stitching ball. It aims to enhance the immediate construction between the ball bladder and the outer carcass with a view to enhance the overall structural integrity of the entire stitching ball.

However, there are also several other disadvantages for the stitching structure of soccer balls. For example, the carcass panels, being stitched onto the ball bladder, involve expensive and time-consuming manufacturing procedures, yet the resulting sports ball may not have the optimal roundness. One particularly-pressing problem for conventional stitched sports ball is that the carcass panels cannot have too sharp a shape for it is difficult for sharp concerns to be adequately stitched with adjacent carcass panels.

As a result, sports balls having a stitch-less structure have been developed to overcome the many conventional deep-seated problems present in stitched sports ball. For example, U.S. Pat. No. 6,685,585 to Hiroshima et al. discloses a ball for a ball game comprising an elastic bladder, a reinforced layer, and a plurality of leather panels. More specifically, each of the leather panels is bonded onto the reinforced layer, wherein a peripheral edge portion of each leather panels is folded toward an inside. A thickness adjusting member is disposed in a void defined by the folded peripheral portions and bonded onto a back of each leather panel. Although this sports ball does not involve stitching on the leather panels, thereby substantially overcoming the disadvantages associated with stitching, it has several other disadvantages.

First, the Hiroshima's patent specifically discloses a bonding technique thereby each of the leather panels is inwardly folded at the corresponding peripheral portion to bond with the thickness adjusting member. Thus, the Hiroshima's patent discloses a state of art where each the leather panels has two portions, a main portion which is above the thickness adjusting member, and a peripheral portion which is bonded at side portions of the corresponding thickness adjusting member. Now, the problem with this construction is that while the main portion of each of the leather panels is elastically supported by the thickness adjusting member, the corresponding peripheral potion does not. As a result, the sports ball suffers from non-uniform cushion effect because of the bonding technique of the leather panels. When a user of that invention kicks on the main portion of the leather panel, he will enjoy substantial cushioning effect from the thickness adjusting member. However, when the user kicks on the peripheral portion of the leather panel, he will cease to enjoy the same amount of cushioning effect as if he kicks on the main portion.

Second, it is reasonably clear that in order to manufacture the ball stated in the Hiroshima's patent, one must take substantial amount of time for precise and effective attachment between the thickness adjusting member and the leather panels. In other words, the ball disclosed in the Hiroshima's patent requires expensive manufacturing cost. Moreover, since the manufacturing procedures are time-consuming, when the balls are needed in large quantity, such as when the inventors or their assignees or the licensors need to meet substantial market demand, there is little chance that they could produce the balls in large quantity in a relatively short period of time. This is extremely important because major soccer events, such as World Cup, are only held once in a few year.

SUMMARY OF THE PRESENT INVENTION

A main object of the present invention is to provide a sports ball comprising a plurality of carcass panels attached on a ball cushion to form a roundness carcass of the sports ball in a stitch-less manner.

Another object of the present invention is to provide a sports ball comprising a plurality of carcass panels each of which has a slanted edge portion, wherein a thickness of the edge portion of each of the carcass panels is gradually reducing towards a peripheral edge thereof. In other words, the present invention does not utilize folding of the carcass panels for attaching on the inflatable bladder, thereby substantially overcoming the above-mentioned shortcomings of the conventional sports ball.

Another object of the present invention is to provide a sports ball comprising a ball cushion which provides a uniform cushioning effect to the entire sports ball for enhancing a performance thereof. A remarkable feature of the present invention is that the carcass panels can be cut into a wide variety of shapes without affecting the cushioning effect of the sports ball, or the attachment effectiveness between the ball carcass and the ball cushion.

Another object of the present invention is to provide a method of manufacturing the above-mentioned sports ball, wherein the manufacturing method is simple, cost-effective, and efficient. In other words, the present invention provides an optimal method of producing a large quantity of sports ball in a relatively short period of time.

Accordingly, the present invention provides a sports ball, comprising:

an inflatable bladder having a valve stem extended therefrom;

a ball pocket, which is constructed to have a true roundness shape, having an interior cavity receiving the inflatable bladder therein, wherein when the inflatable bladder is inflated, the ball pocket retains a true roundness shape of the inflatable bladder; and a ball carcass, which comprises:

a ball cushion, which is constructed to have a true roundness shape, receiving the ball pocket therein; and a plurality of carcass panels, each of the carcass panels having a peripheral edge and a flat bottom surface defined within the peripheral edge, wherein the bottom surface of each of the carcass panels is entirely affixed to the ball cushion at a position that the peripheral edge of each of the carcass panels is fittingly aligned with the peripheral edges of the adjacent carcass panels to form a roundness carcass of the sportsball in a stitch-less manner.

Moreover, the present invention provides a method of manufacturing a sportsball, comprising the steps of:

(a) forming a ball pocket, which is constructed to have a true roundness, having an interior cavity;

(b) disposing an inflatable bladder, having a valve stem, in the ball pocket, wherein when the inflatable bladder is inflated, the ball pocket retains a true roundness shape of the inflatable bladder;

(c) forming a ball cushion, which is constructed to have a true roundness, to receive the ball pocket therein; and (d) affixing a plurality of carcass panels on the ball cushion to form a roundness carcass of the sportsball in a stitch-less manner, wherein each of the carcass panels having a peripheral edge and a flat bottom surface defined within the peripheral edge, wherein the bottom surface of each of the carcass panels is entirely affixed to the ball cushion at a position that the peripheral edge of each of the carcass panels is fittingly aligned with the peripheral edges of the adjacent carcass panels to form the roundness carcass of the sportsball.

These and other objectives, features, and advantages of the present invention will become apparent from the following detailed description, the accompanying drawings, and the appended claims.

DETAILED DESCRIPTION OF THE PREFERRED EMBODIMENT

Figure 1:
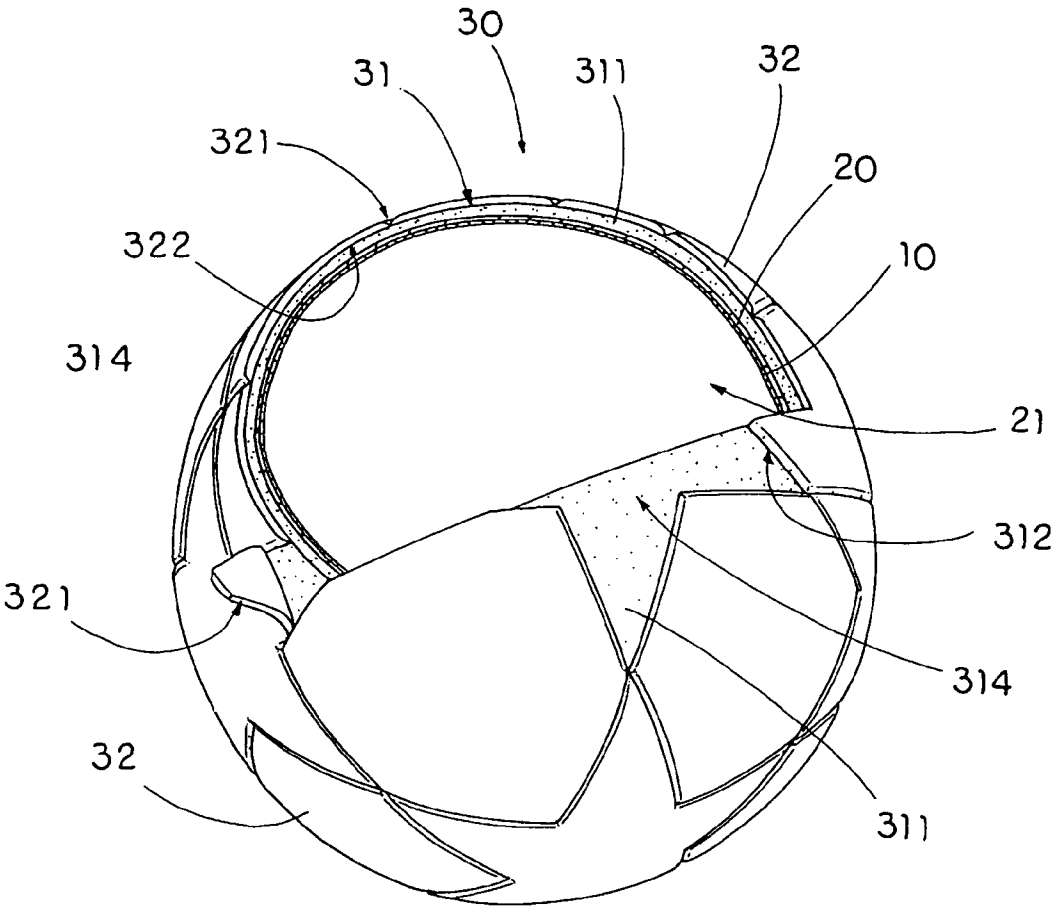
FIG. 1 is a perspective view of a sports ball according to a preferred embodiment of the present invention.
Figure 2:
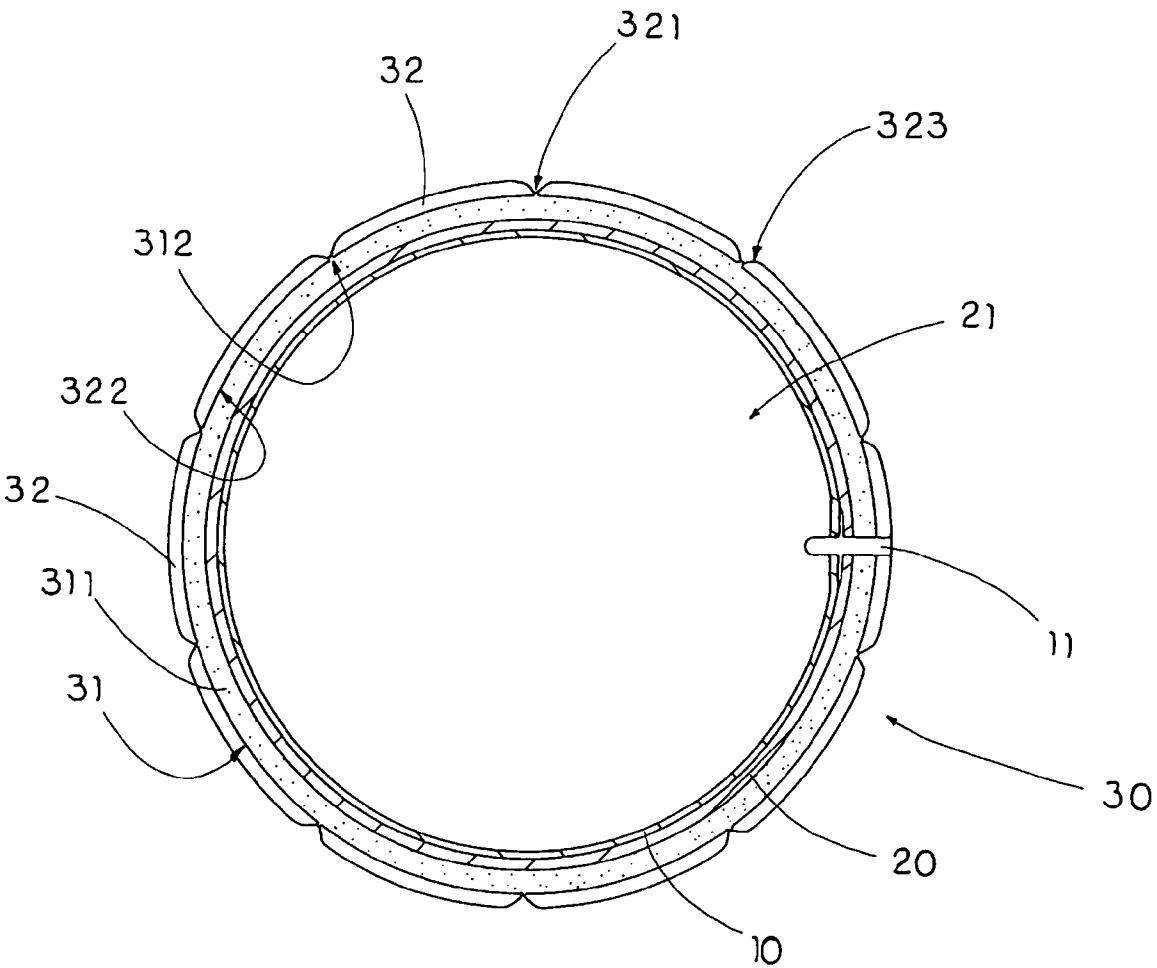
FIG. 2 is a side view of the sports ball according to the above preferred embodiment of the present invention.

Referring to FIG. 1 to FIG. 2 of the drawings, a sports ball, such as a soccer ball, according to a preferred embodiment of the present invention is illustrated, wherein the sports ball comprises an inflatable bladder 10 having a valve stem 11 extended therefrom, a ball pocket 20, and a ball carcass 30.

The ball pocket 20, which is constructed to have a true roundness shape, having an interior cavity 21 receiving the inflatable bladder 10 therein, in which when the inflatable bladder 10 is inflated, the ball pocket 20 retains a true roundness shape of the inflatable bladder 10.

The ball carcass 30 comprises a ball cushion 31 and a plurality of carcass panels 32. The ball cushion 31, which is constructed to have a true roundness shape, is arranged to receive the ball pocket 20 within the ball cushion 31.

Each of the carcass panels 32 has a peripheral edge 321 and a flat bottom surface 322 defined within the peripheral edge 321, wherein the bottom surface 322 of each of the carcass panels 32 is entirely affixed to the ball cushion 31 at a position that the peripheral edge 321 of each of the carcass panels 32 is fittingly aligned with the peripheral edges 321 of the adjacent carcass panels 32 to form a roundness carcass of the sports ball in a stitch-less manner.

According to the preferred embodiment of the present invention, the inflatable bladder 10 is made of flexible plastic materials, such as rubber, wherein the inflatable bladder 10 is adapted to be fully inflated through the valve stem 11 to form a substantially spherical shape.

Moreover, the ball pocket 20 comprises a plurality of pocket panels 22 which are overlappedly laminated with each other side by side and are treated to form an integral spherical structure of the ball pocket 20 so as to retain a true roundness shape of the inflatable bladder 10 after the inflatable bladder 10 has been inflated. Thus, the pocket panels 22 are securely attached onto the inflatable bladder 10 for embedding the inflatable bladder 10 within the ball pocket 20 in the interior cavity 21. As such, the inflatable bladder 10 is substantially enhanced in strength and thereby protected from excessive external impact.

It is worth mentioning that the pocket panels 22 of the ball pocket 20 are preferably made of thin fabric materials having a desirable materials strength so that when the pocket panels 22 are overlappedly attached on the inflatable bladder 10, the ball pocket 20 thereby formed is capable of protecting the inflatable bladder.

In order to further enhance the strength of the ball pocket 20, the ball pocket may further comprise an adhesive layer formed between the pocket panels 22 and an outer surface of the inflatable bladder 10 for ensuring effective protection of the inflatable bladder 10 by the ball pocket 20. It is important to point out that the adhesive layer is optionally in that when the inflatable bladder 10 has been fully inflated, the ball pocket 20 is nevertheless expanded to form a spherical supporting structure for protecting the inflatable bladder 10.

On the other hand, ball cushion 31 of the ball carcass 30 comprises at least a cushion layer 311 which is overlapped on the ball pocket 20 and is treated to form an integral spherical structure of the ball cushion 31, so as to provide a cushion effect for the sports ball at any point thereof. According to the preferred embodiment of the present invention, the cushion layer 311 is made of expandable forming material which is thin when untreated, and when the cushion layer 311 is heat-treated, and preferably vulcanized, the cushion layer 311 is expanded to form a foaming cushion layer of the ball cushion 31. The cushion layer 311 will then provide a uniform cushion effect to the sports ball for ensuring uniform performance thereof when the sports ball is actually in use in a ball game. More specifically, the cushion layer 311 is made of rubber arranged when the cushion layer 311 is heat-treated, the cushion layer 311 forms a spherical foaming cushion around the ball pocket 20. Thus, the inflatable bladder 10 is substantially protected by the ball pocket 20 as well as the cushion layer 311.

The ball cushion 31 further has a plurality of panel guiders 312 which are integrally formed on an outer spherical surface 313 thereof and are shaped corresponding to contours of the carcass panels 32 to guide the carcass panels 32 affixing on the outer spherical surface 313 of the ball cushion 31. According to the preferred embodiment of the present invention, the panel guiders 312 are formed when the cushion layer 311 is treated in a predetermined mold for forming the spherical foaming cushion, wherein the panel guiders 312 are protruded from and extended along the outer spherical surface 313 of the ball cushion 31. The panel guiders 312, being extended along the outer spherical surface 313 of the ball cushion 31, form a corresponding number of panel cavities 314 between at least two panel guiders 312, wherein the contour of the corresponding carcass panels 32 corresponds with the shape of the corresponding panel cavity 314. As such, each of the carcass panels 32 is adapted to be securely attached onto the corresponding panel cavity 314 for form the outermost layer of the sports ball of the present invention. It is worth mentioning that the carcass panels 32 are preferably made of materials which can be chemically dyed or patterned for forming an artistic appearance of the sports ball.

Referring to FIG. 2 of the drawings, each of the carcass panels 32 further has a slanted edge portion 323 extended towards the peripheral edge 321 thereof, wherein a thickness of the slanted edge portion 323 of each of the carcass panels 32 is gradually reducing toward the peripheral edge 321 of the corresponding carcass panel 32. This feature of the sports ball has three advantages: first, the carcass panels 32 are uniformly attached on the ball cushion 31 to provide the uniform cushioning effect over the entire sports ball; second, since the attachment of the carcass panels 32 does not involve any stitching procedure, the carcass panels 32 can be shaped and crafted to have any cross sectional shape without needing to concern if the cross sectional shape is compatible for stitching; third, the aesthetic appearance of the sports ball can be preserved. In fact, according the preferred embodiment of the present invention, at least one of the carcass panels 32 is cut to have a sharp corner having an acute angle to adhere on the ball cushion 31 for forming a desirable aesthetic appearance of the sports ball of the present invention.

Moreover, in order to further enhance the secure attachment between the carcass panels 32 and the ball cushion 31, the peripheral edges 321 of the carcass panels 30 are interlocked with each other to cover on the ball cushion 31 in a hidden manner, in such a manner that the carcass panels 32 are adhered on the ball cushion 31 to form the roundness ball carcass 30 in a stitch-less manner.

It is worth mentioning that as a slight alternative of the preferred embodiment, the ball cushion 31 can comprise a plurality of cushion layers 311 overlappedly affixed to the bottom surfaces 322 of the carcass panels 32 respectively, wherein the cushion layers 311 are overlapped on the ball pocket 20 to form an integral spherical structure of the ball cushion 31, so as to provide a cushion effect for the sports ball at any point thereof.

Figure 3A:
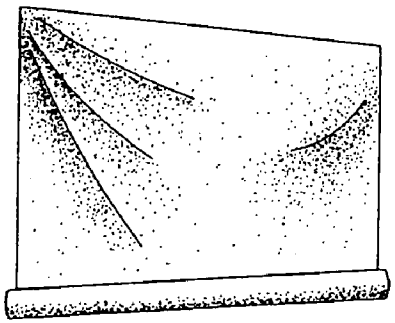
FIG. 3A to FIG. 3V are schematic diagrams of a method of manufacturing a sports ball according to the above preferred embodiment of the present invention.
Figure 3B:
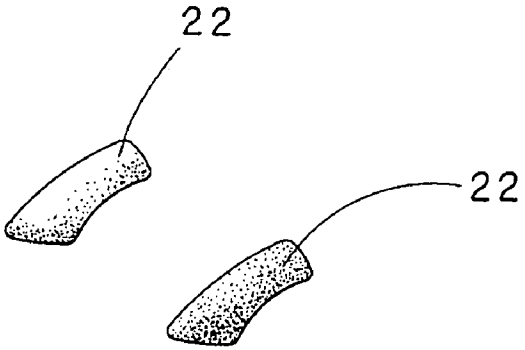
Figure 3C:
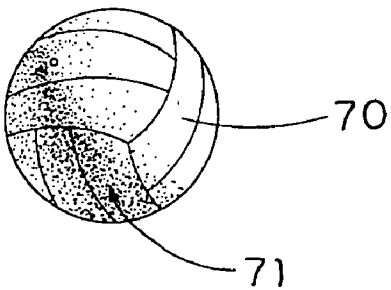
Figure 3D:
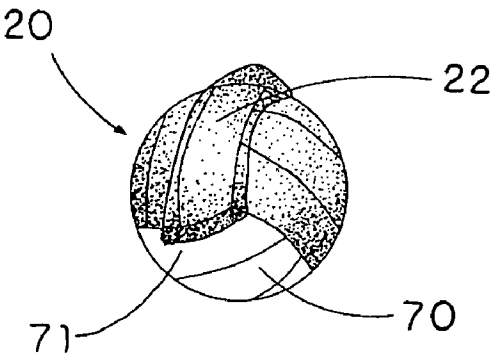
Figure 3F:
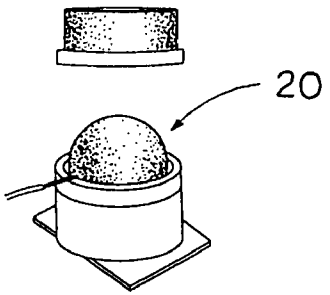
Figure 3H:
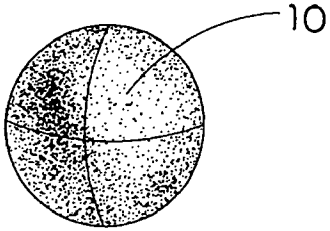
Figure 3E:
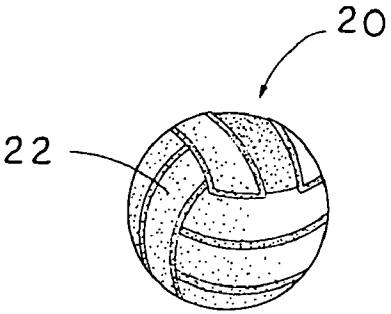
Figure 3G:
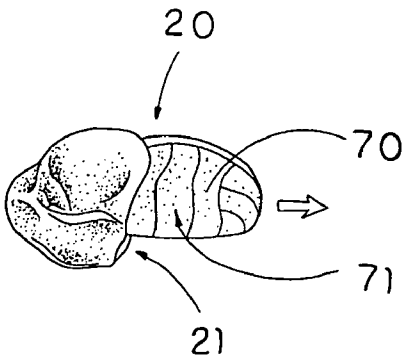
Figure 3J:
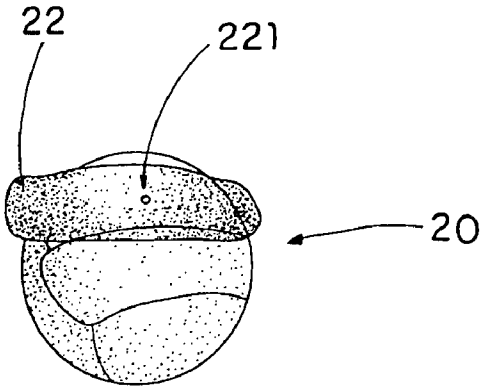
Figure 3L:
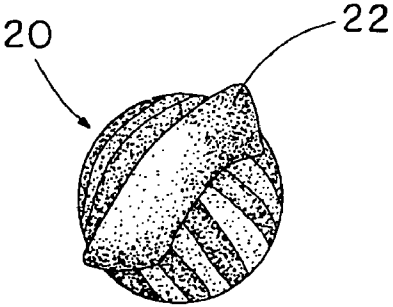
Figure 3I:
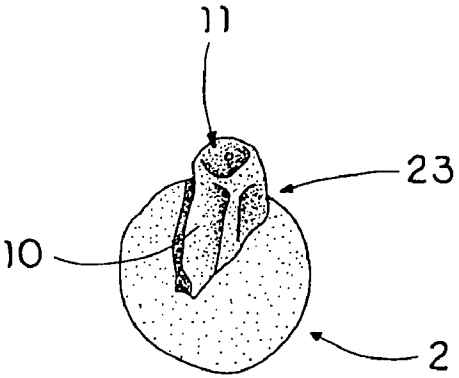
Figure 3K:
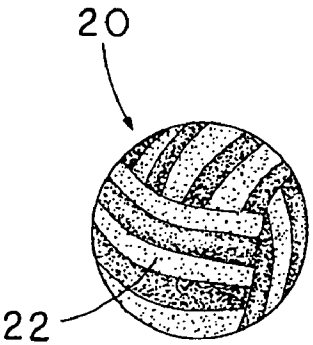
Figure 3N:
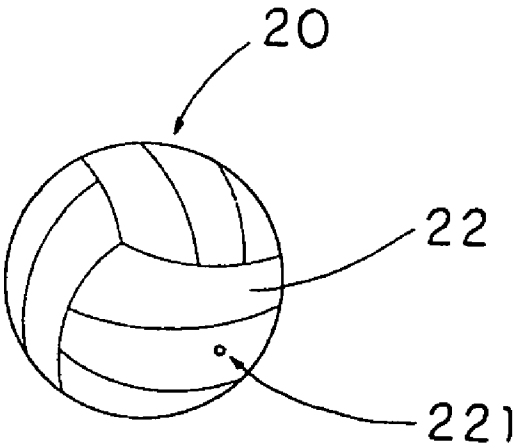
Figure 3M:
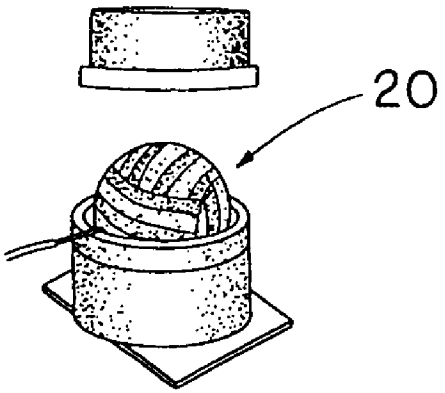
Figure 3P:
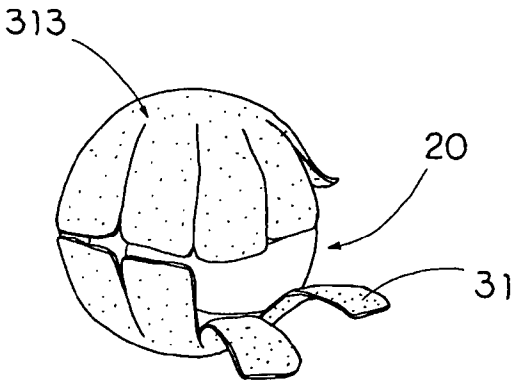
Figure 3R:
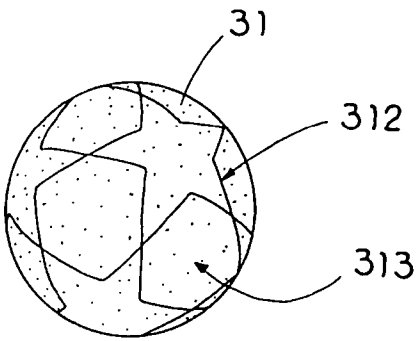
Figure 3O:
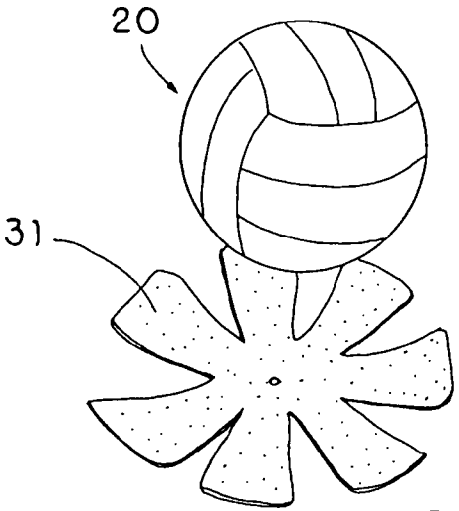
Figure 3Q:
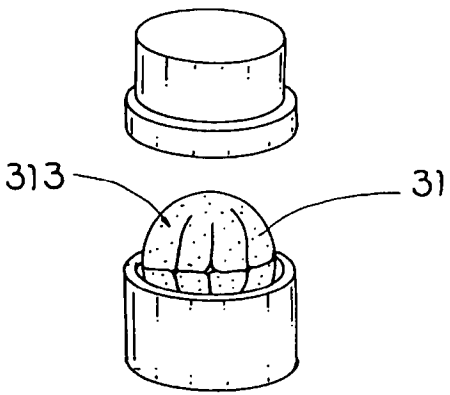
Figure 3T:
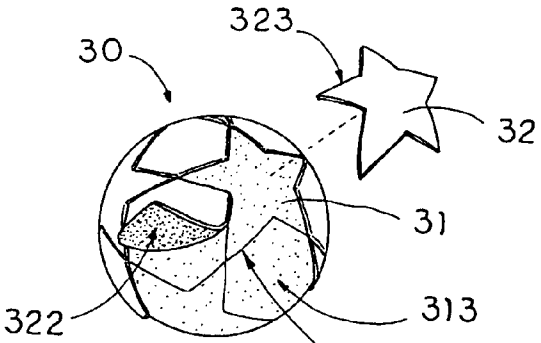
Figure 3V:
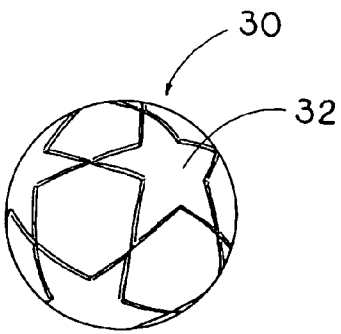
Figure 3S:
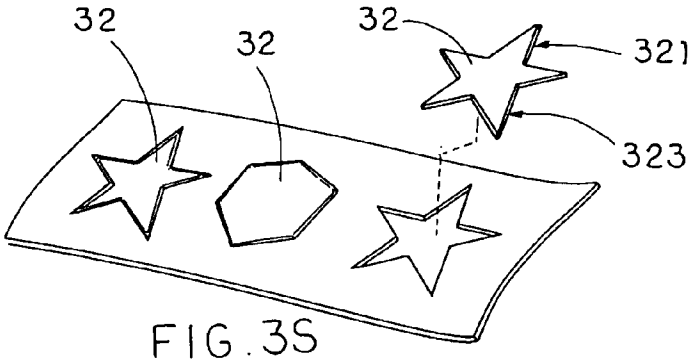
Figure 3U:
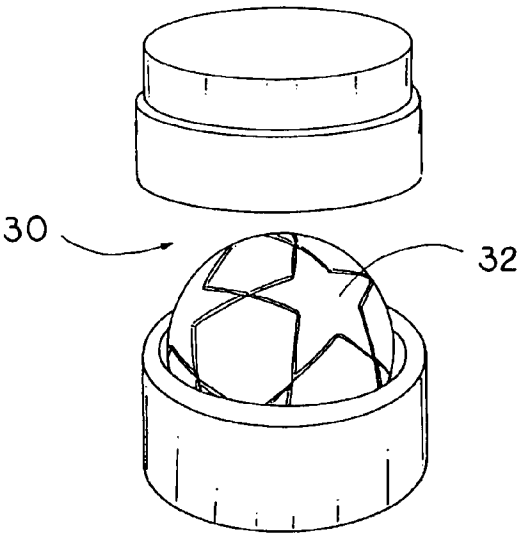

Referring to FIG. 3A to FIG. 3V of the drawings, a method of manufacturing a sports ball according to the preferred embodiment of the present invention is illustrated, in which the method comprises the steps of:

(a) forming a ball pocket 20, which is constructed to have a true roundness, having an interior cavity 21;

(b) disposing an inflatable bladder 10, having a valve stem 11, in the ball pocket 20, wherein when the inflatable bladder 10 is inflated, the ball pocket 20 retains a true roundness shape of the inflatable bladder 10;

(c) forming a ball cushion 31, which is constructed to have a true roundness, to receive the ball pocket 20 therein; and (d) affixing a plurality of carcass panels 32 on the ball cushion 31 to form a roundness ball carcass 30 of the sports ball in a stitch-less manner, wherein each of the carcass panels 32 having a peripheral edge 321 and a flat bottom surface 322 defined within the peripheral edge 321, wherein the bottom surface 322 of each of the carcass panels 32 is entirely affixed to the ball cushion 31 at a position that the peripheral edge 321 of each of the carcass panels 32 is fittingly aligned with the peripheral edges 321 of the adjacent carcass panels 32 to form the roundness ball carcass 30 of the sports ball.

According to the preferred embodiment of the present invention, step (c) comprises the steps of:

(c.1) overlapping at least a cushion layer 31 on the ball pocket 20; and (c.2) heat-treating the cushion layer 31 to form an integral spherical foaming cushion around the ball pocket 20 to provide a cushion effect for the sports ball at any point thereof. Note that the heat treatment can be performed by conventional heating machine.

Moreover, step (c.2) further comprises a step of integrally forming a plurality of panel guiders 312 on an outer spherical surface 313 thereof, wherein the panel guiders 312 are shaped corresponding to contours of the carcass panels 32 to guide the carcass panels 32 affixing on the outer spherical surface 313 of the ball cushion 31.

Step (a) further comprises the steps of:

(a.1) providing a parent bladder 70 having a true roundness shape after the parent bladder 70 is inflated;

(a.2) overlapping a plurality of pocket panels 22 on the parent bladder 70 at a position that edge portions of the pocket panels 22 are overlapped with edge portions of the adjacent pocket panels 22, wherein one of the pocket panels 22, having a valve hole 221, is remained unattached to form an inlet opening 23 of the ball pocket 20;

(a.3) heat-treating the pocket panels 22 to integrally bond the ball panels 22 together to form a hollow round ball body having the inlet opening 23 provided thereon;

(a.4) removing the parent bladder 70 from the hollow round ball body through the inlet opening 23 after the parent bladder 70 is deflated;

(a.5) disposing the inflatable bladder 10 in the hollow round ball body through the inlet opening 23 before the inflatable bladder 10 is inflated; and (a.6) sealing the inlet opening 23 with attaching the unattached pocket panel 22 at a position that the valve hole 221 is aligned with the valve stem 11 to sealedly enclose the interior cavity 21 to from the ball pocket 20.

In order to ensure easy removal of the parent bladder 70 and effective attachment of the pocket panels 22, step (a.2) further comprises the step of applying a removing agent on a spherical surface 71 of the parent bladder 70 and applying an adhering element on the pocket panels 22.

In order to form a slanted edge portion 323 for each of the carcass panels 32, step (d) further comprises a pre-step of pre-cutting each of the carcass panels 32 to form a slanted edge portion 323 extended towards the edge thereof, wherein a thickness of the slanted edge portion 323 of each of the carcass panels 32 is gradually reducing towards the peripheral edge 321.

Moreover, step (d) further comprises a step of interlocking the peripheral edges 321 of the carcass panels 32 with each other to cover on the ball cushion 20 in a hidden manner. Thus, the attachment strength of the carcass panels 32 can be substantially enhanced.

Corresponding with the slight alternative as mentioned above, step (d) may further comprises the steps of overlappedly affixing a plurality of cushion layers 311 to the bottom surfaces 322 of the carcass panels 32 respectively, and overlapping the cushion layers 311 on the ball pocket 20 to form an integral spherical structure of the ball cushion 31 so as to provide a cushion effect for the sports ball at any point thereof.

It should be appreciated from the above disclosure that the sports ball of the present invention can be manufactured efficiently and in a cost-effective manner so as to overcome the above-mentioned shortcomings for conventional sports ball.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method of manufacturing a sportsball, comprising the steps of:

(a) forming a ball pocket, which is constructed to have a true roundness, having an interior cavity, wherein the step (a) further comprises the steps of:

(a.1) providing a parent bladder having a true roundness shape after said parent bladder is inflated;

(a.2) overlapping a plurality of pocket panels on said parent bladder at a position that edge portions of said pocket panels are overlapped with edge portions of adjacent pocket panels, wherein one of said pocket panels, having a valve hole, is remained unattached to form an inlet opening;

(a.3) heat-treating said pocket panels to integrally bond said ball panels together to form a hollow round ball body having said inlet opening provided thereon;

(a.4) removing said parent bladder from said hollow round ball body through said inlet opening after said parent bladder is deflated;

(a.5) disposing an inflatable bladder in said hollow round ball body through said inlet opening before said inflatable bladder is inflated; and (a.6) sealing said inlet opening with attaching said unattached pocket panel at a position that said valve hole is aligned with said valve stem to sealedly enclose said interior cavity to form said ball pocket;

(b) the inflatable bladder, having a valve stem, wherein when said inflatable bladder is inflated, said ball pocket retains a true roundness shape of said inflatable bladder;

(c) forming a ball cushion, which is constructed to have a true roundness, to receive said ball pocket therein; and (d) affixing a plurality of carcass panels on said ball cushion to form a roundness carcass of said sportsball in a stitch-less manner, wherein each of said carcass panels having a peripheral edge and a flat bottom surface defined within said peripheral edge, wherein said bottom surface of each of said carcass panels is entirely affixed to said ball cushion at a position that said peripheral edge of each of said carcass panels is fittingly aligned with said peripheral edges of said adjacent carcass panels to form said roundness carcass of said sportsball.

2. The method, as recited in claim 1, wherein the step (c) comprises the steps of:

(c.1) overlapping at least a cushion layer on said ball pocket; and (c.2) heat-treating said cushion layer to form an integral spherical foaming cushion around said ball pocket to provide a cushion effect for said sportsball at any point thereof.

3. The method, as recited in claim 2, wherein the step (c.2) further comprises the steps of:

(c.21) integrally forming a plurality of panel guiders on an outer spherical surface of said ball cushion, wherein said panel guiders are shaped corresponding to contours of said carcass panels, and (c.22) guiding said carcass panels affixing on said outer spherical surface of said ball cushion.

4. The method, as recited in claim 3, wherein said panel guiders are extended along said outer spherical surface of said ball cushion, forming a corresponding number of panel cavities between at least two said panel guiders, wherein said contour of said corresponding carcass panels corresponds with a shape of said corresponding panel cavity so as to ensure each of said carcass panels being securely attached onto said corresponding panel cavity.

5. The method, as recited in claim 1, wherein the step (a.2) further comprises the step of applying a removing agent on a spherical surface of said parent bladder and applying an adhering element on said pocket panels.

6. The method, as recited in claim 3, wherein the step (a.2) further comprises the step of applying a removing agent on a spherical surface of said parent bladder and applying an adhering element on said pocket panels.

7. The method, as recited in claim 4, wherein the step (a.2) further comprises the step of applying a removing agent on a spherical surface of said parent bladder and applying an adhering element on said pocket panels.

8. The method, as recited in claim 7, wherein said carcass panels are adhered on said ball cushion to form said roundness carcass in a stitch-less manner.

9. The method, as recited in claim 8, wherein at least one of said carcass panels is cut to have a sharp corner having an acute angle to adhere on said ball cushion.

10. The method, as recited in claim 3, wherein the step (d) further comprises a pre-step of pre-cutting each of said carcass panels to form a slanted edge portion extended towards said edge thereof, wherein a thickness of said edge portion of each of said carcass panels is gradually reducing towards said peripheral edge.

11. The method, as recited in claim 4, wherein the step (d) further comprises a pre-step of pre-cutting each of said carcass panels to form a slanted edge portion extended towards said edge thereof, wherein a thickness of said edge portion of each of said carcass panels is gradually reducing towards said peripheral edge.

12. The method, as recited in claim 10, wherein the step (d) further comprises a step of interlocking said peripheral edges of said carcass panels with each other to cover on said ball cushion in a hidden manner.

13. The method, as recited in claim 11, wherein the step (d) further comprises a step of interlocking said peripheral edges of said carcass panels with each other to cover on said ball cushion in a hidden manner.

14. The method, as recited in claim 12, wherein the step (d) further comprises the steps of overlappedly affixing a plurality of cushion layers to said bottom surfaces of said carcass panels respectively, and overlapping said cushion layers on said ball pocket to form an integral spherical structure of said ball cushion so as to provide a cushion effect for said sportsball at any point thereof.

15. The method, as recited in claim 13, wherein the step (d) further comprises the steps of overlappedly affixing a plurality of cushion layers to said bottom surfaces of said carcass panels respectively, and overlapping said cushion layers on said ball pocket to form an integral spherical structure of said ball cushion so as to provide a cushion effect for said sportsball at any point thereof.

* * * * *